US007086870B1

(12) United States Patent
Sutcliffe

(10) Patent No.: US 7,086,870 B1
(45) Date of Patent: Aug. 8, 2006

(54) ELECTRICAL CONNECTOR (RECEPTACLE) WITH EASILY REMOVABLE BOTTOM

(75) Inventor: Roger F. Sutcliffe, Northport, NY (US)

(73) Assignee: Mill-Max Mfg. Corp,, Oyster Bay, NY (US)

( * ) Notice: Subject to any disclaimer, the term of this patent is extended or adjusted under 35 U.S.C. 154(b) by 194 days.

(21) Appl. No.: 10/714,349

(22) Filed: Nov. 15, 2003

(51) Int. Cl.
*H01R 12/00* (2006.01)

(52) U.S. Cl. ..... 439/75; 439/426

(58) Field of Classification Search ..... 439/75, 439/134, 851, 74, 46, 82, 295, 426, 320, 439/933; 29/864, 830, 842, 845, 874; 438/614
See application file for complete search history.

(56) References Cited

U.S. PATENT DOCUMENTS

| | | | | |
|---|---|---|---|---|
| 4,390,221 | A * | 6/1983 | Niles et al. | 439/83 |
| 4,797,113 | A * | 1/1989 | Lambert | 439/74 |
| 5,290,970 | A * | 3/1994 | Currie | 174/250 |
| 6,325,280 | B1 * | 12/2001 | Murphy | 228/246 |
| 6,644,983 | B1 * | 11/2003 | Recktenwald et al. | 439/75 |
| 2005/0106909 | A1 * | 5/2005 | Dickie | 439/134 |

OTHER PUBLICATIONS

Cambion Connector Jacks.
Mill-Max.
AMP.

* cited by examiner

*Primary Examiner*—Truc T. Nguyen
*Assistant Examiner*—Edwin A. Leon
(74) *Attorney, Agent, or Firm*—David S. Woronoff

(57) ABSTRACT

A structure of an array of connectors fastened to a planar insulator, usually formed of a high temperature thermoplastic. The planar insulator has a pattern of substantially cylindrical openings formed therein into which is inserted a machined copper alloy sleeve which is plated with tin or tin-lead alloy. The sleeve itself is a hollow substantially cylindrical tube with a multi-finger spring contact inserted near one (usually called the upper end). The spring contact itself is plated with gold, tin, tin-lead or other malleable electrically conductive material. At the far end of the cylindrical tube is fixed a plug of "kraft paper" to function as a barrier, made from substantially pure wood pulp with no fillers. The cylindrical tube of the sleeve grips the kraft paper barrier sufficiently for it to remain in place during the processing cycle when the copper alloy sleeve is soldered to the circuit board. The "kraft paper" is stable and unaffected by the temperature to which the solder is heated to become fluid and can be easily removed by the insertion of a connector lead into the sleeve.

5 Claims, 2 Drawing Sheets

ELECTRICAL CONNECTOR (RECEPTACLE) WITH EASILY REMOVABLE BOTTOM

BACKGROUND OF THE INVENTION

The present invention relates to a novel electrical connector that is attached to a printed circuit board by soldering, in which the connector is a receptacle usually, but not necessarily, arranged in an array, such as, a single row, dual row, triple row, dual-in-line, pin grid array or other configuration of grid. The receptacle has placed or formed within it a spring contact for mechanically gripping another connector which will be inserted into it. One end of the connector is sealed by a removable material which is resistant to the heat of the soldering and at the same time protects the spring contact from contamination with flux and liquid solder.

FIELD OF THE INVENTION

The present invention relates to the field of electrical connectors arranged in arrays for soldering to a printed circuit board. Printed circuit boards with arranged arrays of contact receiving orifices are the sine qua non of modern electronics including but not limited to computers of all types and descriptions, telecommunications equipment of all kinds, displays, television, radio, radar, sonar, toys for tots and so on. The list of the items which utilize this precise electrical interconnect structure is virtually endless. The universal problem with these interconnect devices is how to solder the connector to the circuit board without damaging the spring contact within the connector. Many solutions have been tried. Some worked effectively enough to protect the spring connector but in so doing the opening at one end of the connector is itself sufficiently plugged as to make the connector useless or difficult to use for its intended purpose. The most common of those solutions was the use of a metallic "knock-out" bottom which required a separate tool to be inserted into each receptacle to remove the metal bottom forcibly, assuming of course that the receptacle bottom had not been soldered so well that it could not be dislodged at all or without breaking the connector or circuit board. These solutions are shown in data sheets of Amp, Mill-Max, and Cambion, copies of which are attached to this application as Information Disclosure Statement by Applicant.

DESCRIPTION OF THE PRIOR ART

The closest prior art known to the applicant is shown by the attached Data Sheets. None of these teachings show either the physical structure or the function taught by the present invention. They show the use of a metal cover over one end of the receptacle which requires a metal tool to dislodge it, if it hasn't been soldered to the receptacle during the soldering process. If that happens it is difficult or even impossible to remove the cover.

SUMMARY OF THE INVENTION

The present invention teaches, in a number of embodiments, a novel structure and function of an array of connectors fastened to a planar insulator, usually formed of a high temperature thermoplastic. The planar insulator has a pattern of substantially cylindrical openings formed therein into which is inserted a machined copper alloy sleeve which is plated with tin or tin-lead alloy. The sleeve itself is a hollow substantially cylindrical tube with a multi-finger spring contact inserted near one (usually called the upper end). The spring contact itself is plated with gold, tin, tin-lead or other malleable electrically conductive material. At the far end of the cylindrical tube is fixed a plug of "kraft paper" to function as a barrier, made from substantially pure wood pulp with no fillers. The cylindrical tube of the sleeve grips the kraft paper barrier sufficiently for it to remain in place during the processing cycle when the copper alloy sleeve is soldered to the circuit board. The "kraft paper" is stable and unaffected by the temperature to which the solder is heated to become fluid and can be easily removed by the insertion of a connector lead into the sleeve.

DESCRIPTION OF THE PREFERRED EMBODIMENT

Figure 1:
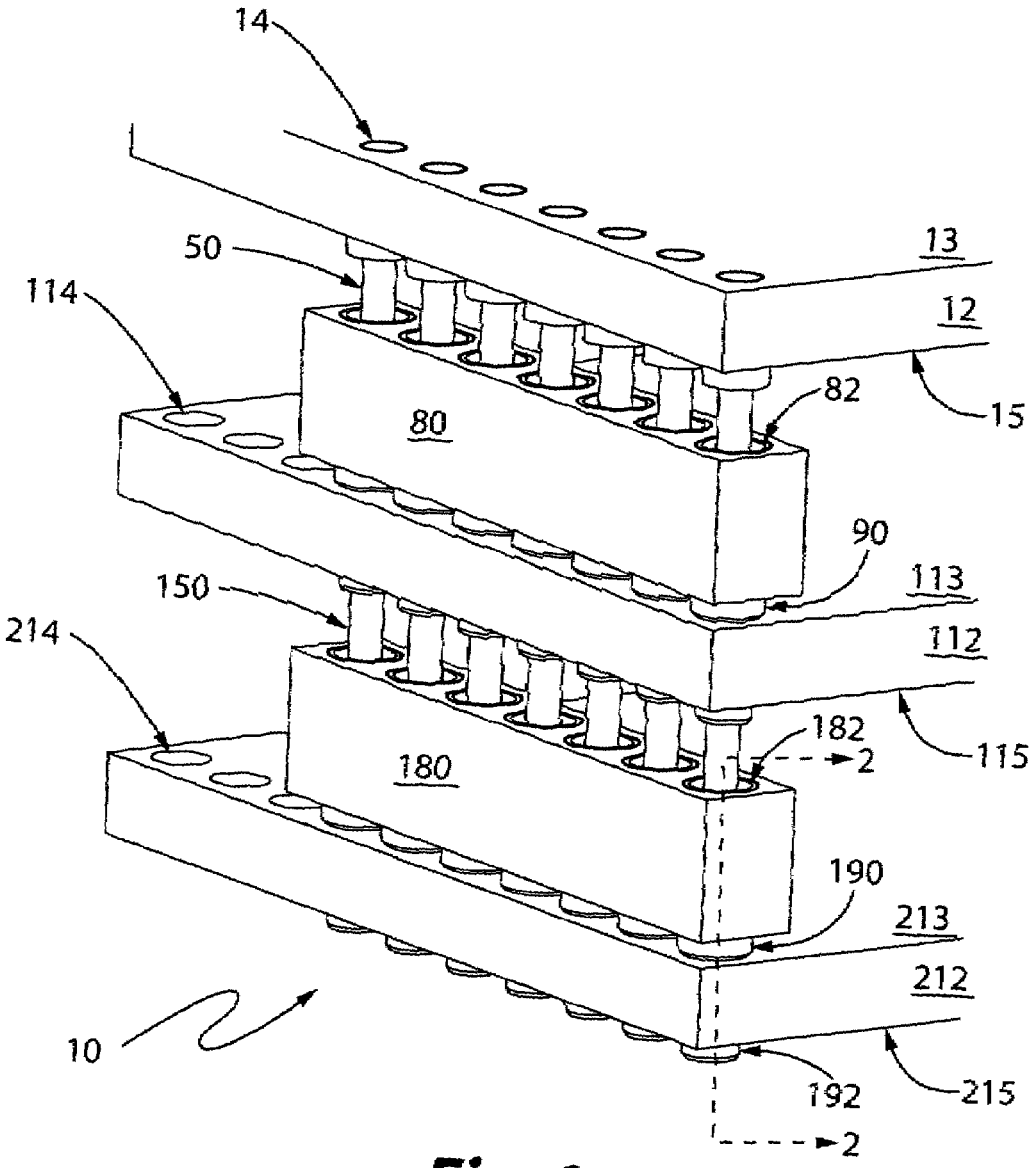
FIG. 1 shows in perspective a three layer circuit board assembly showing one embodiment of the invention

FIG. 1 is perspective view of a first embodiment of the present invention showing by the number 10, by way of example and not limitation, a three-layer circuit board assembly. The circuit boards are shown as parts 12, 112, 212 in which like parts have like numbers preceded by the numeral 1 or 2. Each circuit board has an array of plated through orifices 14, 114, 214 respectively. Interconnecting the circuit boards are sockets 80, 180 with interconnection pins 50, 150.

Each circuit board has an upper and lower surface 13, 15, 113, 115, 213, 215 respectively as shown in FIG. 1. The sockets 80, 180 have through channels 82, 182 into which are inserted interconnection pins 50, 150.

Figure 2:
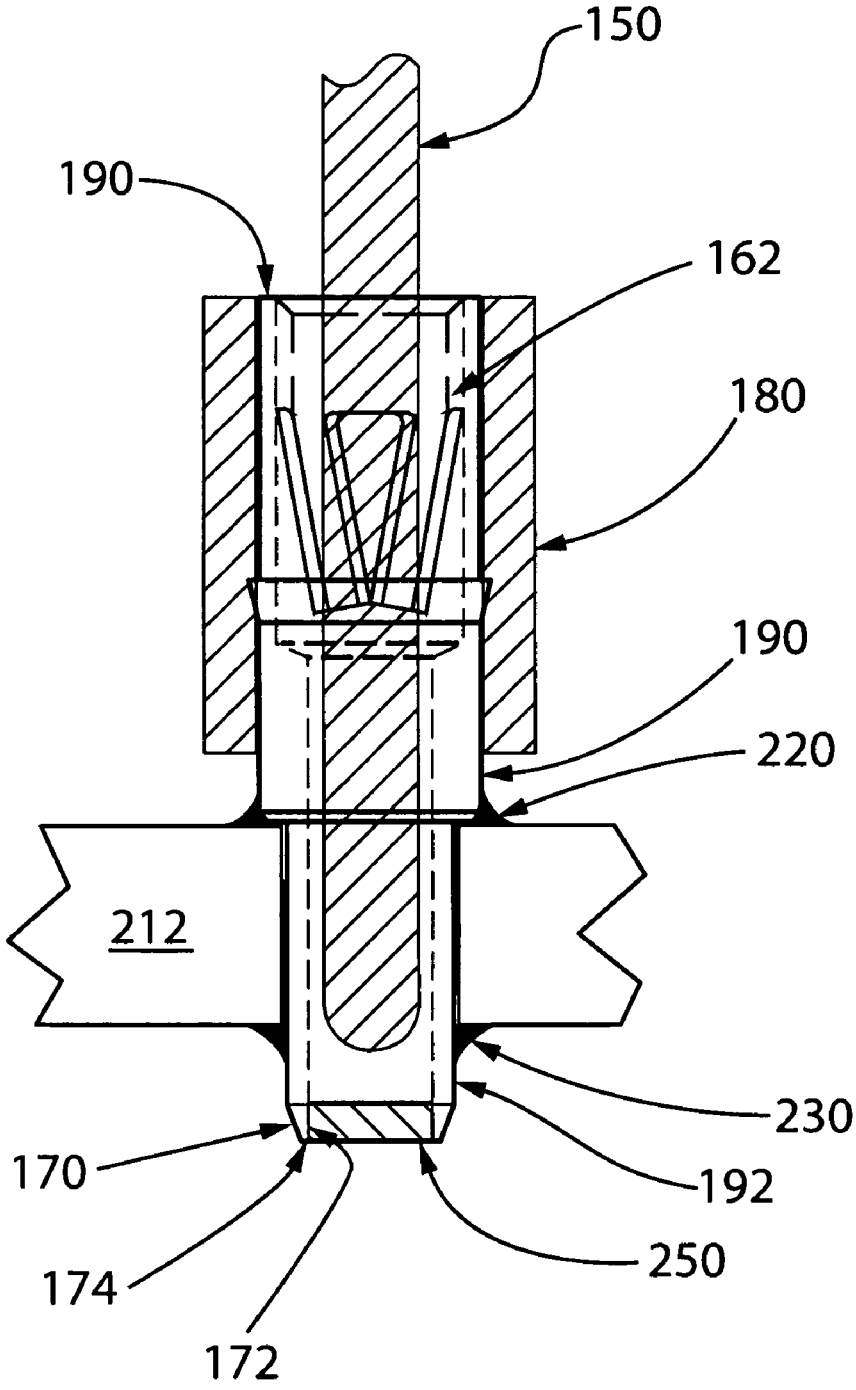
FIG. 2 is a sectional view taken along the line 2—2 shown in FIG. 1 and shows the inter-connection pin in the sleeve and being gripped by the contact spring before pushing out the kraft paper barrier.

Looking at the detail shown in FIG. 2 for the socket and interconnection pin portion of the invention is the socket insulator having a socket sleeve 190 inserted there through. A multi-finger spring contact 62, 162 formed from spring temper copper alloy which is inserted into the upper end of the socket sleeve. The lower end (as shown in the Figure) of the socket sleeve has in this embodiment a smaller diameter extension 192 for soldering to the lowest circuit board 212.

The lower end of socket sleeve, more particularly the far end of the sleeve (opposite the end having the spring contact) has an edge formed by the taper of (normally) vertical outer side 170 which forms a sharp edge 174 at its near intersection with inner diameter surface 172 of the sleeve. This sharp edge surface of the sleeve captures the kraft paper plug 250 which forms the protective barrier for the sleeve during soldering. The soft, easily removable barrier 250 protects the inner sleeve and spring contact from flux vapor and molten solder during the operations which form the solder joints 220, 230 shown in FIG. 2. When the interconnection pin 150 is inserted into the sleeve 190 it engages the spring contact 162 and can be easily driven through the plug 250 (without the use of another tool) to make an electrical connection with the circuit board 212 below.

I claim:

1. An apparatus for interconnecting electrical parts on at least one circuit board having a pattern of electrically conductive elements thereon comprising in combination:

at least one socket means having a particular array of electrically conductive through passages formed thereon which pattern mates with the pattern on a circuit board;

the socket means having connected to it a socket sleeve member which has a conductive passageway through it; the socket sleeve member having a contact member therein for receiving an interconnecting pin member which fits through the sleeve member and engages the contact member placed within the sleeve;

a relatively soft barrier means formed at one end of the sleeve member adapted to be easily removed by the insertion of the interconnecting pin member.

2. The apparatus claimed in claim 1 including wherein said soft barrier means is formed of kraft paper.

3. The apparatus claimed in claim 1 wherein the near end of the sleeve member is formed into a sharp edge member.

4. The apparatus claimed in claim 1 wherein the sleeve member has an outer surface which is tapered inward towards its center to form a sharp edge with the inner cylindrical surface.

5. The apparatus claimed in claim 1 wherein the cylindrical sleeve member is formed on one end thereof to trap and retain in possession the barrier means until an interconnecting pin member is placed therein to dislodge the barrier means.

* * * * *